United States Patent [19]

Marshall

[11] Patent Number: 4,958,432

[45] Date of Patent: Sep. 25, 1990

[54] ROTARY HAIR TRIMMER

[76] Inventor: Willie J. Marshall, 7131 Paseo Blvd., Kansas City, Mo. 64132

[21] Appl. No.: 426,673

[22] Filed: Oct. 26, 1989

[51] Int. Cl.[5] ..... B26B 19/00

[52] U.S. Cl. ..... 30/29.5; 30/43.6

[58] Field of Search ..... 30/29.5, 43.4, 43.5, 30/43.6, 346.51

[56] References Cited

U.S. PATENT DOCUMENTS

| | | | |
|---|---|---|---|
| 2,987,818 | 6/1961 | Rosenstein | 30/29.5 X |
| 3,381,373 | 5/1968 | Brown . | |
| 3,524,253 | 8/1970 | Hoke . | |
| 3,731,379 | 5/1973 | Williams . | |
| 3,925,888 | 12/1975 | Bozsangi . | |
| 4,521,962 | 6/1985 | Van Natta . | |
| 4,719,698 | 1/1988 | Minomiya et al. | 30/43.6 |

*Primary Examiner*—Douglas D. Watts
*Attorney, Agent, or Firm*—Jerry T. Kearns

[57] ABSTRACT

A rotary hair trimming device for trimming body hair in the nose, ears, and other locations includes a housing having an internal rotary electric motor. A rechargeable battery is selectively connectable to the motor by a switch for driving a generally cylindrical cutting head. Electrical contacts in a base of a housing are engageable with a recharging base for recharging the batteries when the device is not in use. The cutting head is formed by a series of circular disks spaced along a central shaft. Thin rectangular cutting blades are circumferentially spaced about a periphery of each disk. A hemispherical zone is formed on an end portion of the cutting head by a plurality of arcuate segment blades. A generally cylindrical cap is secured over the cutting head and includes a plurality of hair receiving apertures. The cutting head is provided in different sizes for performing various different trimming operations. A specially configured plier type tool is disclosed for removing and installing the cutting heads.

20 Claims, 4 Drawing Sheets

ROTARY HAIR TRIMMER

BACKGROUND OF THE INVENTION

1. Field of the Invention

The present invention relates to hair trimmers, and more particularly pertains to rotary hair trimmer specifically designed for trimming human body hair in the nose, ears, and other locations.

2. Description of the Prior Art

Various types of hair trimmers are known in the prior art. A typical example of such a hair trimmer is to be found in U.S. Pat. No. 3,381,373, which issued to E. Brown on May 7, 1968. This patent discloses a battery powered rotary shaver having a conical tapering cutting head formed by a plurality of circumferentially spaced blades. The blades have radially outwardly directed cutting edges and are covered by a generally conical shaped cap including a plurality of hair receiving slits. U.S. Pat. No. 3,524,253, which issued to A. Hoke on Aug. 18, 1970, discloses a self contained rotary hair trimming tool having a rotary cutter head driven by a battery powered electric motor. U.S. Pat. No. 3,731,379, which issued to R. Williams on May 8, 1973, discloses a hair trimming device having a pair of cutting blades. One of the blades is formed as a sheath within which the other blade is contained. Perforations in the wall of the sheath blade are arranged to admit the ends of the hairs to be cut into the interior of the sheath where the second blade, which has helical cutting edges, cooperates with the sheath to effect a shearing action. U.S. Pat. No. 3,925,888, which issued to W. Bozsanyi on Dec. 16, 1975, discloses a hair trimmer for the nose and ears which has a conically shaped hollow open ended cutting head. A blade is fitted within the head and is rotated by a battery powered electric motor. U.S. Pat. No. 4,521,962, which issued to H. Van Natta on June 11, 1985, discloses a hair trimmer for cutting nose and ear hair. The device includes a shielding element and a cutting element rotatably driven within the shielding element to effect a shearing action.

While the above mentioned devices are directed to hair trimmers, none of these devices disclose a hair trimmer having a generally cylindrical cutting blade including a plurality of thin rectangular blades mounted about the periphery of each of a plurality of axially spaced disks. Additional features of the present invention, not contemplated by the aforesaid prior art devices, include the provision of a hemispherical cutting zone formed by a plurality of arcuate segment blades, for the use of a generally cylindrical blade enclosing aperture cap having a hemispherical end portion. Inasmuch as the art is relatively crowded with respect to these various types of hair trimmers, it can be appreciated that there is a continuing need for and interest in improvements to such hair trimmers, and in this respect, the present invention addresses this need and interest.

SUMMARY OF THE INVENTION

In view of the foregoing disadvantages inherent in the known types of hair trimmers now present in the prior art, the present invention provides an improved rotary hair trimmer. As such, the general purpose of the present invention, which will be described subsequently in greater detail, is to provide a new and improved rotary hair trimmer which has all the advantages of the prior art hair trimmers and none of the disadvantages.

To attain this, a representative embodiment of the concepts of the present invention is illustrated in the drawings and makes use of a rotary hair trimming device for trimming body hair in the nose, ears, and other locations, which includes a housing having an internal rotary electric motor. A rechargeable battery is selectively connectable to the motor by a switch for driving a generally cylindrical cutting head. Electrical contacts in a base of a housing are engageable with a recharging base for recharging the batteries when the device is not in use. The cutting head is formed by a series of circular disks spaced along a central shaft. Thin rectangular cutting blades are circumferentially spaced about a periphery of each disk. A hemispherical zone is formed on an end portion of the cutting head by a plurality of arcuate segment blades. A generally cylindrical cap is secured over the cutting head and includes a plurality of hair receiving apertures. The cutting head is provided in different sizes for performing various different trimming operations. A specially configured plier type tool is disclosed for removing and installing the cutting heads.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseologY, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rotary hair trimmer which has all the advantages of the prior art hair trimmers and none of the disadvantages.

It is another object of the present invention to provide a new and improved rotary hair trimmer which may be easily and efficiently manufactured and marketed.

It is a further object of the present invention to provide a new and improved rotary hair trimmer which is of a durable and reliable construction.

An even further object of the present invention is to provide a new and improved rotary hair trimmer which is susceptible of a low cost of manufacture with regard to both materials and labor, and which accordingly is then susceptible of low prices of sale to the consuming public, thereby making such hair trimmers economically available to the buying public.

Still yet another object of the present invention is to provide a new and improved rotary hair trimmer which provides in the apparatuses and methods of the prior art some of the advantages thereof, while simultaneously overcoming some of the disadvantages normally associated therewith.

Still another object of the present invention is to provide a new and improved rotary hair trimmer having an improved cutting head construction for trimming ear, nose and other human body hair.

Yet another object of the present invention is to provide a new and improved rotary hair trimmer having a plurality of cutting heads in different sizes for use in performing various trimming operations.

Even still another object of the present invention is to provide a new and improved rotary hair trimmer having a novel cutting head construction for rapidly and efficiently trimming human body hair in difficult to access locations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
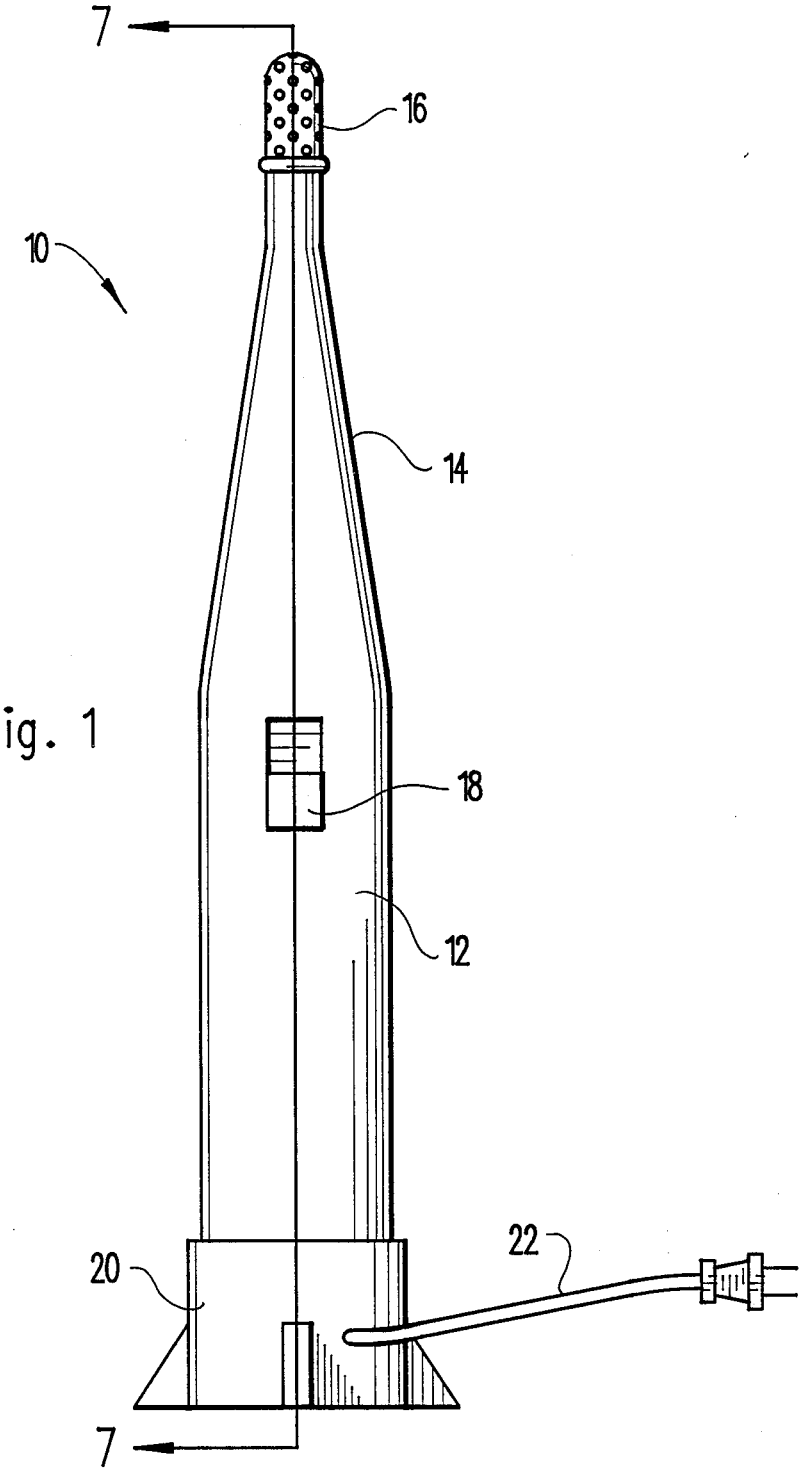
FIG. 1 is a side elevational view of the rotary hair trimmer according to the present invention.

With reference now to the drawings, and in particular to FIG. 1 thereof, a new and improved rotary hair trimmer embodying the principles and concepts of the present invention and generally designated by the reference numeral 10 will be described.

More specifically, it will be noted that the first embodiment 10 of the invention includes a generally cylindrical housing 12 having a forward end portion 14 forming a frustoconical taper. A removable cap 16 is frictionally retained at a small end of the tapered portion 14. The cap 16 covers a rotary cutting head. A switch 18 extends through a slot formed in a side wall of the housing 12 and serves to actuate an enclosed rotary motor. A recharging base 20 has a power cord 22 for connection to a conventional source of AC electric current.

Figure 2:
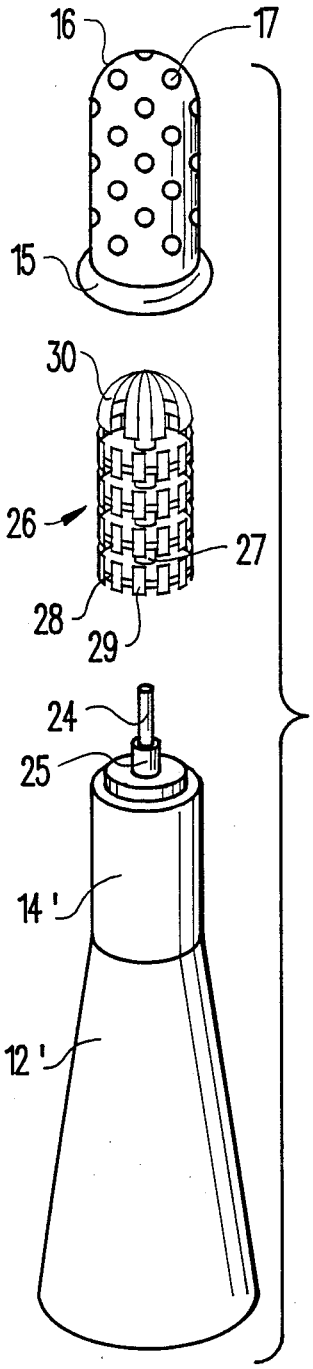
FIG. 2 is an exploded perspective view illustrating the rotary hair to the present invention.

As shown in FIG. 2, the lower portion of the housing 12' may have frusto conical taper and the upper end portion 14' may have a cylindrical shaped, without departing from the scope of the present invention. A rotary output shaft 25 has a reduced diameter threaded portion 24 for connection with a generally cylindrical cutting head 26. The cutting head 26 includes a central cylindrical shaft or arbor 27 having an internal threaded passage for engagement with the threaded portion 24 of the rotary shaft 25. The cutting head 26 includes a plurality of disks 28 disposed along the axis of the arbor 27. A pluralitY of thin, rectangular cutting blades 29 are circumferentially spaced about the periphery of each of the disks 28. At a top end portion of the cutting head 26, a plurality of arcuate, segment-shaped blades 30 are circumferentially spaced about the shaft 27 and form a generally hemispherical cutting zone. Each of the arcuate segment blades 30 has a thin construction and presents a sharpened cutting edge in a direction facing a forwards rotation. The rectangular blades 29 similarly are each provided with a sharpened cutting edge facing a forwards direction of rotation. A generally cylindrical cap 16 has a plurality of spaced hair receiving apertures 17. The cap 16 includes a lower peripheral flange 15 dimensioned for snap type frictional engagement with the upper end portion of the housing end 14'. The cap 16 is dimensioned for close conformance with the cutting head 26 such that hair passing through each of the apertures 17 will be severed by the cutting edges of the blades 29 and 30.

Figure 3:
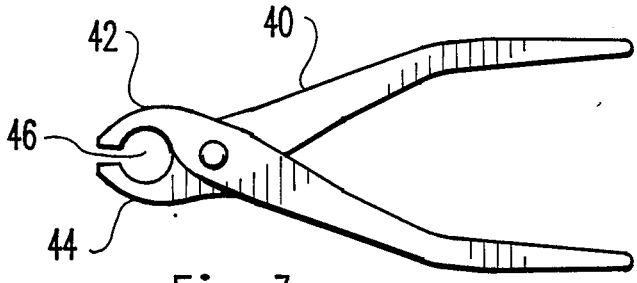
FIG. 3 is a top plan view illustrating a modified plier tool for removing and installing the cutting head of the hair trimmer of the present invention.

FIG. 3 illustrates a plier type tool 40 having arcuate pivotal jaws 42 and 44 forming a generally circular working space 46.

Figure 4:
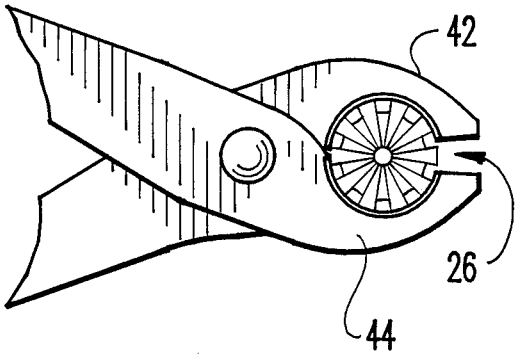
FIG. 4 is a detail view illustrating the manner of use of the tool of 3 to remove or install a cutting head.

As shown in FIG. 4, the jaws 42 and 44 are movable into frictional engagement with the cutting head 26 to effect installation or removal from the rotary output shaft 25.

Figure 5:
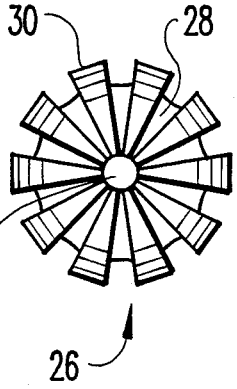
FIG. 5 is a top end view illustrating the cutting head of the hair trimmer of the present invention.

FIG. 5 is a top end view of the cutting head 26, illustrating the upper end of the central arbor 27. The arcuate segment shape of the blades 30 may now be clearly understood.

Figure 6:
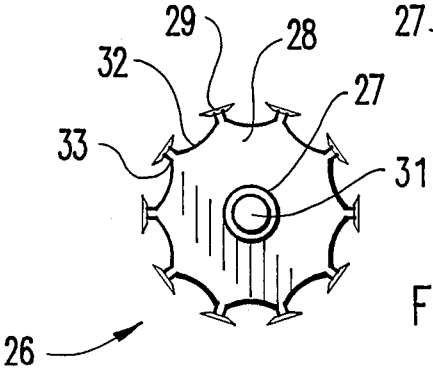
FIG. 6 is a bottom end view illustrating the cutting head of the hair of the present invention.

FIG. 6 is a bottom end view of the cutting head 26 and illustrates the bottom most disk 28. The generally rectangular blades 29 may be mounted on short radial spokes 33. A concave depression or recess 32 is preferably formed in the periphery of the disks 28 between each adjacent pair of blades 29. This forms a clearance zone for effecting the removal of trimmed hair, and prevents interference with the cutting action.

Figure 7:
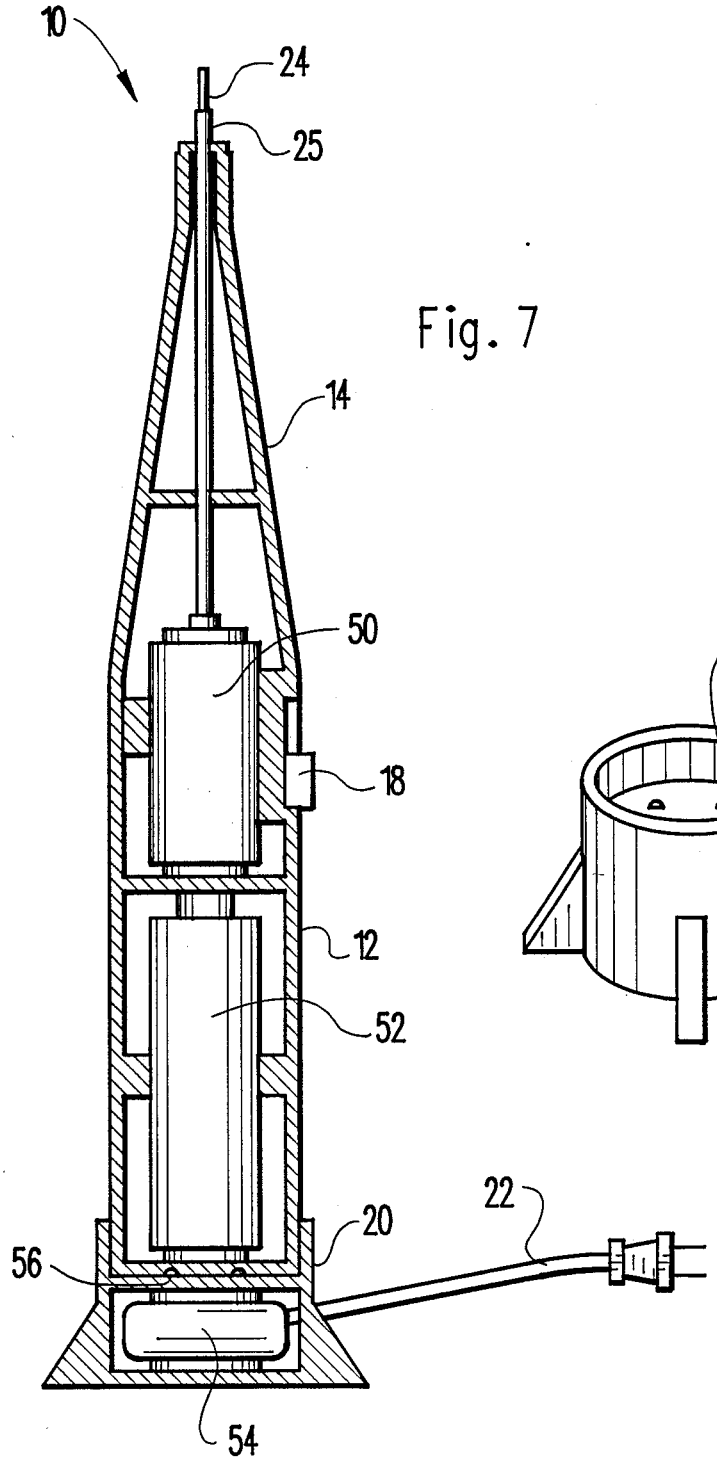
FIG. 7 is a longitudinal cross sectional view, taken along line 7—7 of FIG. 1.

FIG. 7 is a longitudinal cross sectional view, taken along line 7—7 of FIG. 1 and illustrates the interior electric motor 50 and rechargeable battery pack 52. An electrical connection 56 is formed by inter-engaging prongs and recesses, creating an electrical connection between the battery pack 52 and a recharging unit 54 located in the recharging base 20. This connection is automatically effected by inserting the housing 12 into the base 20, such that the battery pack 52 will be recharged when the rotary trimmer 10 is not in use.

Figure 8:
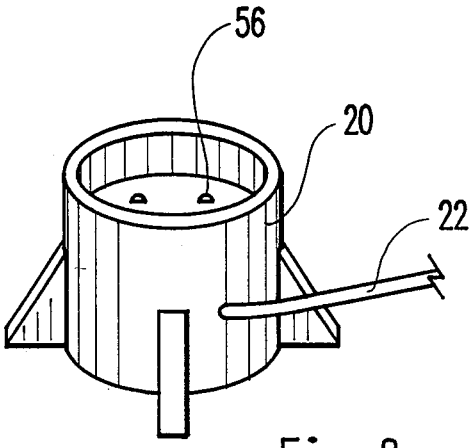
FIG. 8 is a perspective view illustrating the recharging base hair trimmer of the present invention.

FIG. 8 is a perspective view which illustrates the portion of the electrical connectors 56 within the recharging base 20.

Figure 9:
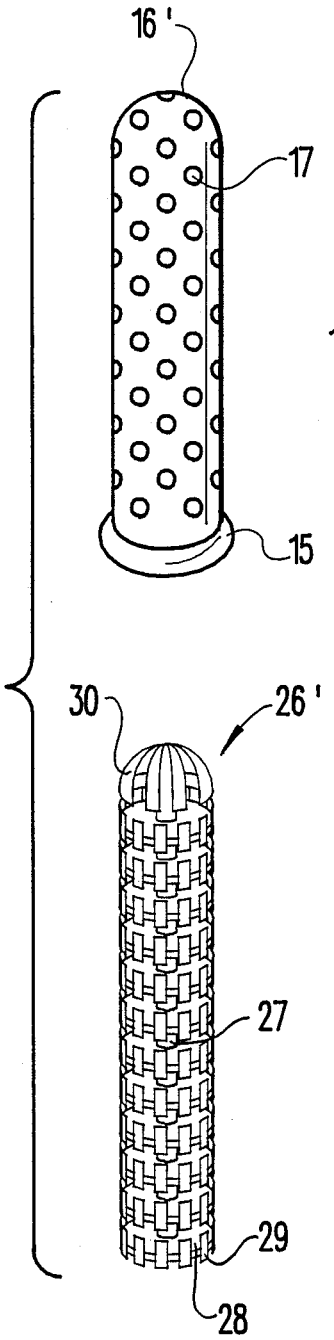
FIG. 9 is an exploded perspective view illustrating an intermediate head and cap assembly.

As shown in FIG. 9, an intermediate length cutting head 26' may be formed by increasing the length of the central arbor 27 and increasing the number of disks 28 spaced therealong. Similarly, the length of the cap 16' is increased to insure a closed surrounding conformance of the cap 16' with the cutting head 26'.

Figure 10:
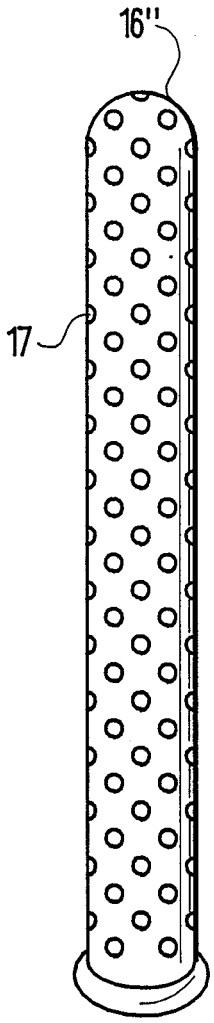
FIG. 10 is a view illustrating a long length cutting head cap.
Figure 11:
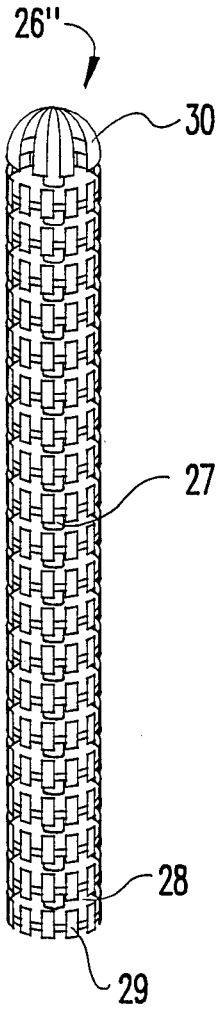
FIG. 11 a perspective view illustrating a long length cutting head.

FIG. 10 illustrates a long length cap 16'' for use with the long length cutting head 26'' shown in FIG. 11. Preferably, the cutting heads are each formed with a diameter of about ¼ inch and lengths of ½, 1 and 2 inches. These three sizes enable the use of the trimming device to trim body hair in a variety of locations. Additionally, it should be noted that by the use of a rotary bristle brush, the housing unit 12 of the rotary trimmer may also be utilized as a rotary electric toothbrush.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A rotary hair trimmer, comprising:
a housing;
a rotary electric motor in said housing;
an output shaft connected to said motor and extending exteriorly of said housing;
means for selectively supplying electric current to said motor;
a cutting head secured to a free end of said output shaft;
said cutting head having a generally cylindrical shape and including a plurality of circumferentially spaced blades; and
said blades arranged in a plurality of axially spaced circular rings.

2. The rotary hair trimmer of claim 1, wherein said circumferentially spaced blades are rectangular.

3. The rotary hair trimmer of claim 1, wherein said circumferentially spaced blades are thin blades each having a sharpened cutting edge facing a forward rotational direction.

4. The rotary hair trimmer of claim 1, further comprising a plurality of arcuate segment blades forming a hemispherical zone on an end of said cutting head.

5. The rotary hair trimmer of claim 1, further comprising a generally cylindrical cap surrounding said cutting head.

6. The rotary hair trimmer of claim 5, wherein said cap has a plurality of hair receiving apertures.

7. The rotary hair trimmer of claim 5, wherein said cap has a hemispherical end portion.

8. The rotary hair trimmer of claim 1, wherein said blades forming each of said circular rings are secured in circumferentially spaced relation about a periphery of a disk.

9. The rotary hair trimmer of claim 8, wherein said circumferentially spaced blades are secured to said disks by short radial spokes.

10. The rotary hair trimmer of claim 9, wherein a concave recess is formed in said disk periphery between each adjacent pair of circumferentially spaced blades.

11. A rotary hair trimmer, comprising:
a housing;
a rotary electric motor in said housing;
an output shaft connected to said motor and extending exteriorly of said housing;
means for selectively supplying electric current to said motor;
a cutting head secured to a free end of said output shaft;
said cutting head having a generally cylindrical shape and including a plurality of circumferentially spaced blades; and
a plurality of arcuate segment blades forming a hemispherical zone on an end of said cutting head.

12. The rotary hair trimmer of claim 11, wherein said circumferentially spaced blades are rectangular.

13. The rotary hair trimmer of claim 11, wherein said circumferentially spaced blades are thin blades each having a sharpened cutting edge facing a forward rotational direction.

14. The rotary hair trimmer of claim 11, further comprising a generally cylindrical cap surrounding said cutting head.

15. The rotary hair trimmer of claim 14, wherein said cap has a plurality of hair receiving apertures.

16. The rotary hair trimmer of claim 14, wherein said cap has a hemispherical end portion.

17. The rotary hair trimmer of claim 11, wherein said circumferentially spaced blades are secured in circumferentially spaced relation about a periphery of a disk.

18. The rotary hair trimmer of claim 17, wherein said circumferentially spaced blades are secured to said disks by short radial spokes.

19. The rotary hair trimmer of claim 17, wherein a concave recess is formed in said disk periphery between each adjacent pair of circumferentially spaced blades.

20. A rotary hair trimmer, comprising:
a housing;
a rotary electric motor in said housing;
an output shaft connected to said motor and extending exteriorly of said housing;
means for selectively supplying electric current to said motor;
a cutting head secured to a free end of said output shaft;

said cutting head having a generally cylindrical shape and including a plurality of circumferentially spaced thin rectangular blades;

said circumferentially spaced blades arranged in a plurality of axially spaced circular rings;

said circumferentially spaced blades forming each of said rings secured in circumferentially spaced relation about a periphery of a disk;

said circumferentially spaced blades are secured to said disks by short radial spokes;

a concave recess formed in said disk periphery between each adjacent pair of circumferentially spaced blades;

each of said circumferentially spaced blades having a sharpened cutting edge facing a forward rotational direction;

a plurality of arcuate segment blades forming a hemispherical zone on an end of said cutting head;

a generally cylindrical cap having a hemispherical end portion and surrounding said cutting head; and a plurality of hair receiving apertures formed in said cap.

* * * * *